US006994066B2

(12) United States Patent
Liu

(10) Patent No.: US 6,994,066 B2
(45) Date of Patent: Feb. 7, 2006

(54) MANUAL ENGINE STARTER

(76) Inventor: Nai Wen Liu, P.O. Box 63-150, Taichung City (406) (TW)

( * ) Notice: Subject to any disclaimer, the term of this patent is extended or adjusted under 35 U.S.C. 154(b) by 0 days.

(21) Appl. No.: 10/876,876

(22) Filed: Jun. 24, 2004

(65) Prior Publication Data

US 2005/0268876 A1 Dec. 8, 2005

(30) Foreign Application Priority Data

Jun. 8, 2004 (TW) ..... 93209021 U

(51) Int. Cl.
*F02N 3/02* (2006.01)

(52) U.S. Cl. ..... 123/185.3; 74/7 C

(58) Field of Classification Search ..... None
See application file for complete search history.

(56) References Cited

U.S. PATENT DOCUMENTS 5,765,438 A * 6/1998 Chang ..... 123/185.3

* cited by examiner

*Primary Examiner*—Andrew M. Dolinar

(57) ABSTRACT

A manual engine starter includes a starting device having a driven shaft selectively connected to a crank of the engine and a drive shaft connected to the driven shaft for driving the driven shaft and starting the engine. The drive shaft has a tubular drive portion formed with a guide side and the driven shaft having a driven portion that is rotatably received in the tubular drive portion and engaged to the guide side and moved along the guide so as to make the driven shaft moved along an axis thereof when the drive shaft is rotated to drive the driven shaft. A puller laterally is mounted the starting device for driving the drive shaft to drive the driven shaft.

3 Claims, 8 Drawing Sheets

MANUAL ENGINE STARTER

BACKGROUND OF THE INVENTION

1. Field of the Invention

The present invention relates to an engine starter, and more particularly to a manual engine starter for a radio control vehicle.

2. Description of Related Art

A conventional manual engine starter in accordance with the prior art shown in FIG. 7 comprises a T-shape shaft (5) having a first end connected to a free end of a crank (4) that is longitudinally secured to a bottom of the piston (3). The piston (3) is reciprocally movably received in a chamber (2) in the engine (1). The T-shaped shaft (5) has a second end detachably connected to a puller (6). The puller (6) can instantly rotate the T-shape shaft (5) to sequentially drive the crank (4) and the piston (3) and make the piston (3) be reciprocally moved in the chamber (2) for starting the engine (1). However, the T-shaped shaft (5) does not disengage from the crank (4) after the engine (1) being started and is rotated due to the operating engine (1). It will cause a disadvantage of wasting energy to the engine (1).

Accordingly, the above manual engine starter is altered to separate the T-shaped shaft (5) from the crank (4) after the engine is started. With reference to FIG. 8, the structure of the altered manual engine starter is similar to that in FIG. 7. The T-shaped shaft (5) has a tapered groove (5B) defined in a distal face (5A) formed on the first end thereof. The tapered groove (5B) is eccentric relative to an axis of the T-shaped shaft (5). A spring (4A) is laterally compressively received in the free end of the crank (4), and a stub (4B) is reciprocally received in the free end of the crank (4) and abuts against the spring (4A). The stub (4B) corresponds to the tapered groove (5B) in the distal face (5A) of the T-shaped shaft (5) and selectively engaged to the tapered groove (5B) due to the restitution force of the spring (4A). Consequently, the T-shaped shaft (5) drive to the crank (4) with the piston (3) to start the engine when the stub (4B) is engaged to the tapered groove (5B).

However, the distal end of the stub (4B) always abuts the distal face (5A) of the T-shaped shaft (S) when the engine has been started. Consequently, the stub (4B) continually abuts the distal face (5A) of the T-shaped shaft (S). As a result, the stub (4B) extends to strike the bottom of the tapered groove (5B) and a vibration is formed between the engine and the starter when the stub (4B) is rotated to a place in which the tapered groove (5B) defined. In addition, the friction between the stub (4B) and the distal face (5A) will offset some power from the engine, and the conventional engine starter may not be used when the stub (4B) is worn out.

The present invention has arisen to mitigate and/or obviate the disadvantages of the conventional manual engine starters.

SUMMARY OF THE INVENTION

The main objective of the present invention is to provide an improved manual engine starter that can effectively the engine and prevent the engine from wasting energy.

To achieve the objective, the manual engine starter in accordance with the present invention comprises a starting device having a driven shaft selectively connected to a crank of the engine and a drive shaft connected to the driven shaft for driving the driven shaft and starting the engine. The drive shaft has a tubular drive portion formed with a guide side and the driven shaft having a driven portion that is rotatably received in the tubular drive portion and engaged to the guide side and moved along the guide so as to make the driven shaft moved along an axis thereof when the drive shaft is rotated to drive the driven shaft. A puller laterally is mounted the starting device for driving the drive shaft to drive the driven shaft.

Further benefits and advantages of the present invention will become apparent after a careful reading of the detailed description with appropriate reference to the accompanying drawings.

DETAILED DESCRIPTION OF THE INVENTION

Figure 1:
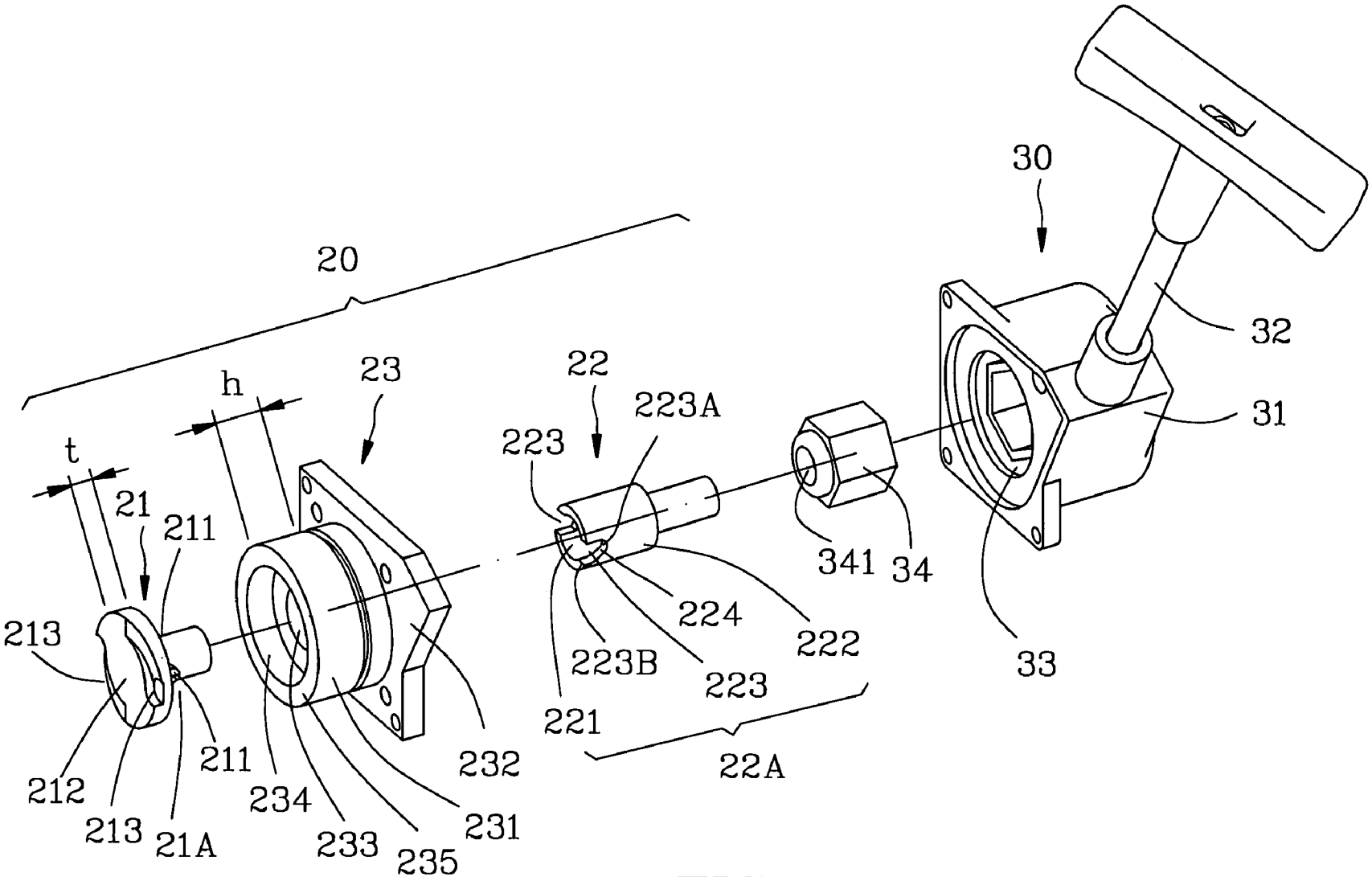
FIG. 1 is an exploded perspective view of a manual engine starter in accordance with the present invention.
Figure 2:
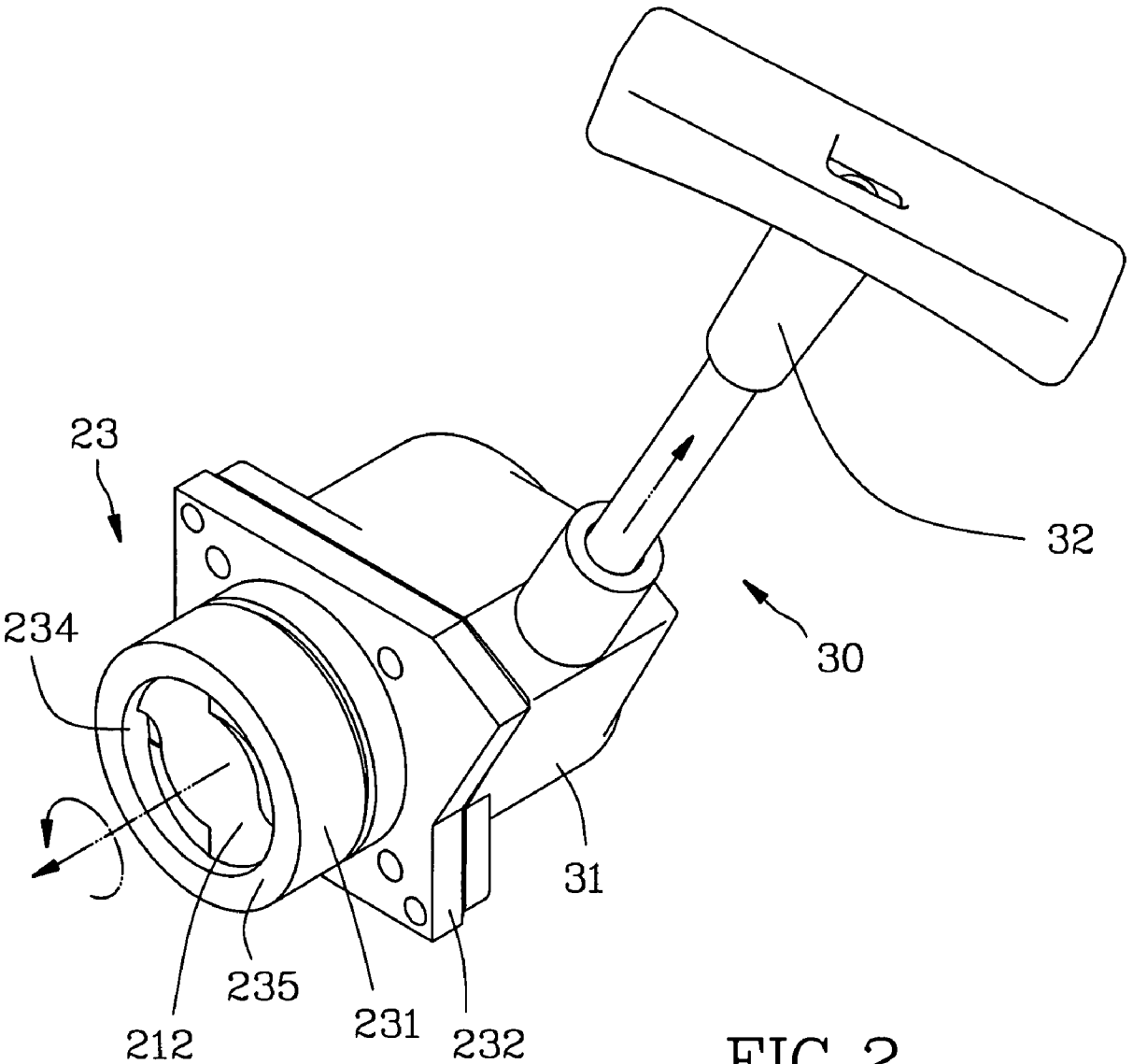
FIG. 2 is a perspective view of the manual engine starter in accordance with the present invention.

Referring to the drawings and initially to FIGS. 1–4, a manual engine starter in accordance with the present invention is adapted to be laterally mounted to an engine (10) of a radio control toy. The engine (10) includes a chamber (11) defined therein and a piston (12) reciprocally movably received in the chamber (11). A crank (13) includes a first end pivotally connected to a bottom of the piston (12) and a second end having a protrusion (131) laterally extending therefrom toward the manual engine starter on the present invention.

The manual engine starter in accordance with the present invention comprises a starting device (20) laterally mounted to the engine and selectively connected to the protrusion (131), and a puller (30) laterally mounted to the starting device (20) for driving the starting device (20).

The puller (3) includes a housing (31) secured on the starting device (20) and a polygonal seat (33) is reciprocally rotatably received in the housing (31) for coiling a rope (not shown) that has a first end secured on an outer periphery and a second end extending through the housing (31) after the rope being coiled on the polygonal seat (33). A handle (32) is securely connected to the second end of the rope for user to easily operate the puller (30). A spring (not shown) is mounted between the polygonal seat (33) and the housing (31) for providing a restitution force to the polygonal seat (33) after being rotated to drive the starting device (20). A one-way clutch (34) is received in and engaged to the polygonal seat (33) and has a hole (341) centrally defined in the one-way clutch (34).

The starting device (20) includes a seat (23) adapted to be laterally mounted to the engine (10) and the housing (30) of the puller (30) is laterally secured on the seat (23). The seat (23) includes a base member (232) secured on the engine (10), and a protrusion (231) extending from the base member (231) and received in the engine (10). A skirt (235) longitudinally extends from the protrusion (231) to define a cavity (234) in a free end of the seat (23) and a through hole (233) is defined in the starting device (20). The through hole (233) co-axially communicates with the cavity (234).

A drive shaft (22) has a first end secured in the hole (341) in the one-way clutch (34) and a second end formed with a tubular drive portion (22A), which is rotatably received in the through hole (233) in the seat (23). The tubular drive portion (22A) includes hole (221) longitudinally defined therein and two indentations (223) defined in an outer periphery (222) of the tubular drive portion (22A). The two indentations (223) diametrically correspond to each in the distal end of the tubular drive portion (22A) and laterally communicate with the hole (221) in the tubular drive portion (22A). Each indentation (223) has a guide side (224) formed on side thereof and corresponding to each other and a receiving space (223A) formed therein. Each guide side (224) has a flat (223B) formed near a distal end of the drive shaft (22) opposite to the one-way clutch (34).

A driven shaft (21) includes a drive dish (212) rotatably received in the cavity (234) and adapted to be selectively engaged to the protrusion (131) of the crank (13). Two tapered grooves (213) are defined in a periphery of the drive dish (212) and diametrically correspond to each other. The cavity (234) has a depth (h) greater than a total of the thickness (t) and the depth of the tapered groove (213). A driven portion (21A) centrally extends from the driven dish (212) and rotatably received in and selectively engaged to the tubular drive portion (22A). Two locking pins (211) laterally secured on an outer periphery of the driven portion (21A) and diametrically correspond to each other. The drive shaft (22) drives the driven shaft (21) when the two locking pins (211) respectively received in and engaged to a corresponding one of the two indentations (223).

Figure 3:
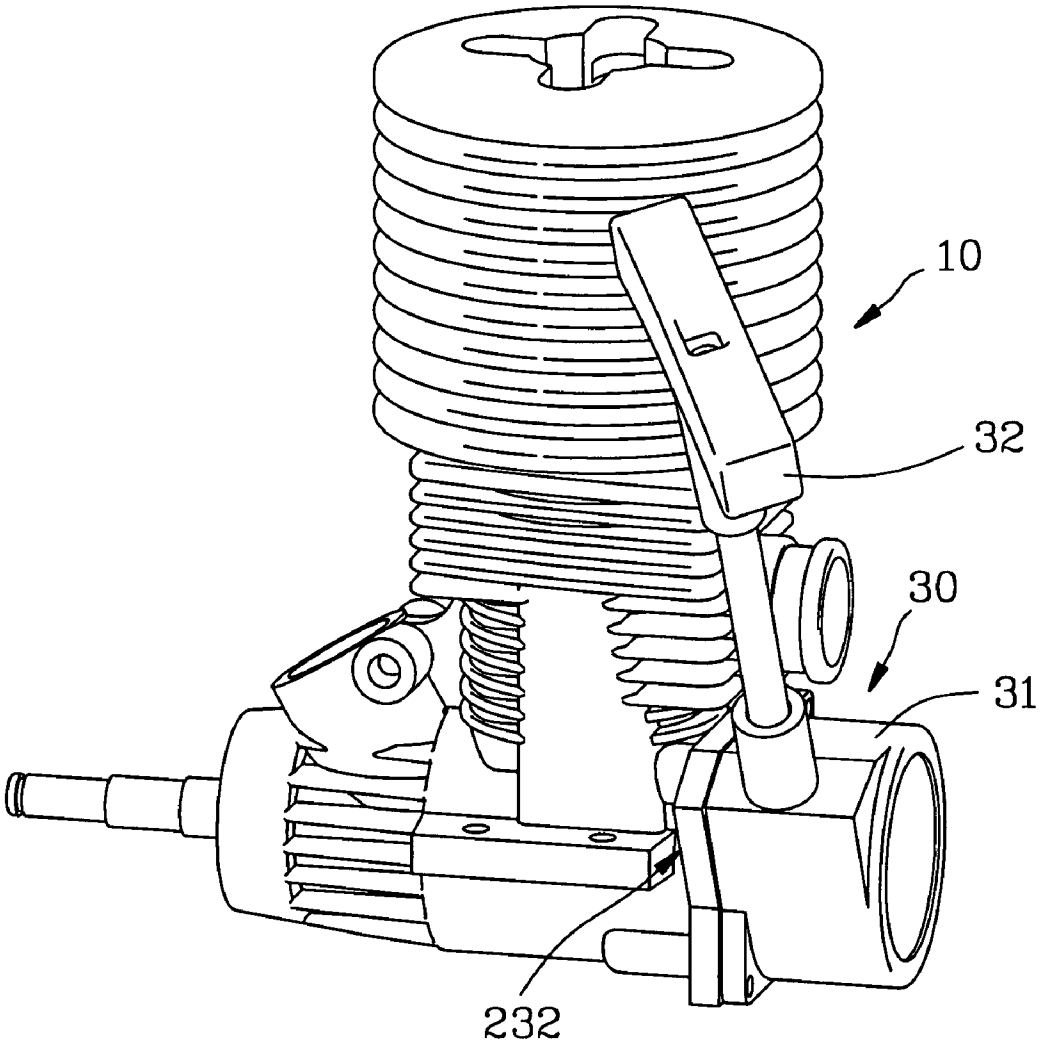
FIG. 3 is a perspective schematic view of the manual engine starter in FIG. 2.
Figure 4:
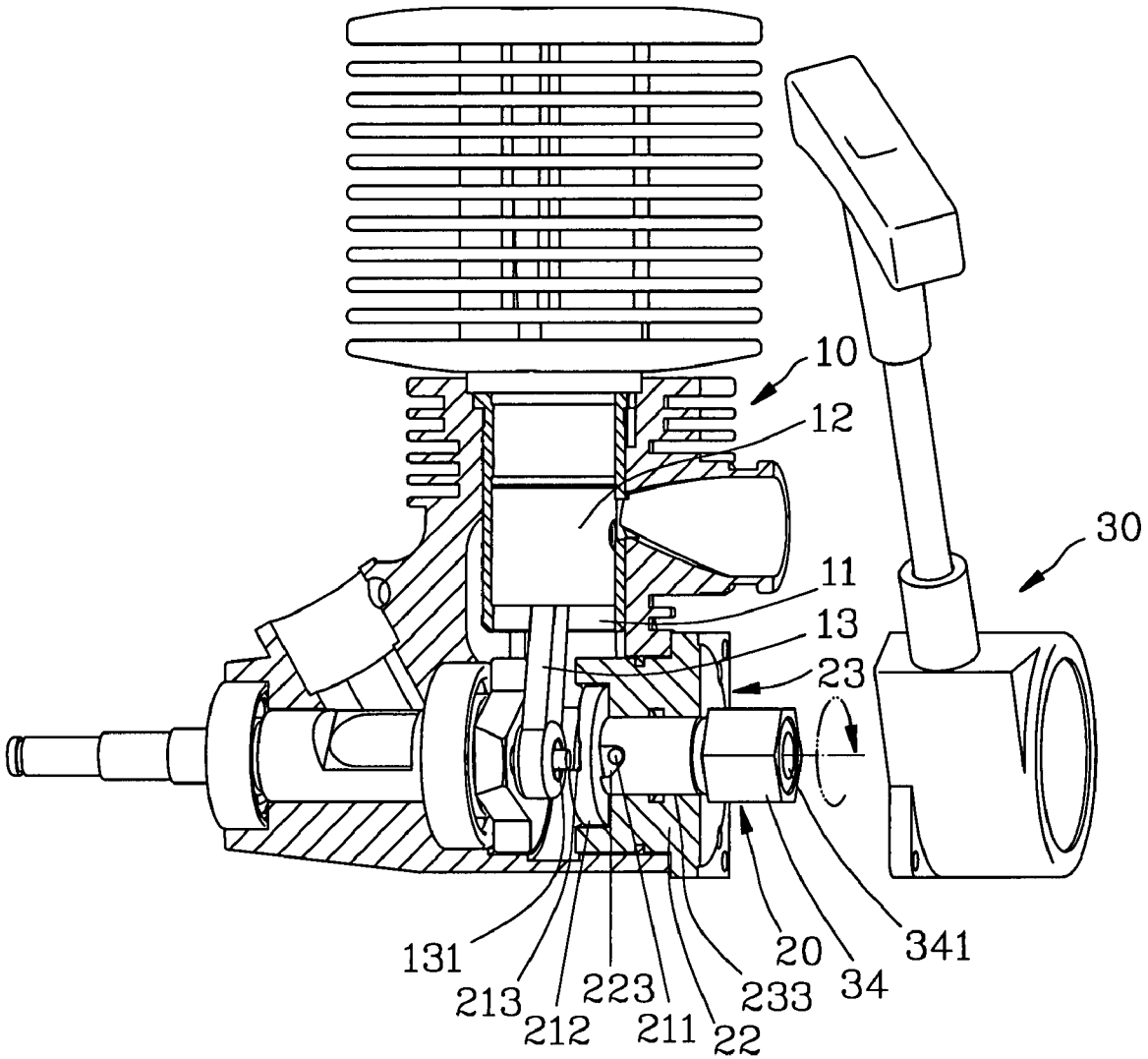
FIG. 4 is a perspective schematic view of the manual engine starter in FIG. 2 when the one-way clutch is separated from the puller.

With reference to FIGS. 1, 3 and 4, the driven portion (21A) is previously received in the hole (221) in the tubular drive portion (22A) and the two locking pins (211) are respectively received in the receiving space (223A) of a corresponding one of the two indentations (223). One end of the drive shaft (22) opposite to the driven shaft (21) is secured in the hole in the one-way clutch (34). The polygonal seat (33) is sleeve on the one-way clutch (34). Lastly, multiple bolts (not shown) sequentially extend through the puller (30) and the base member (232) of the seat (23), and are screwed into the engine (10) for holding the present invention in place.

Figure 5:
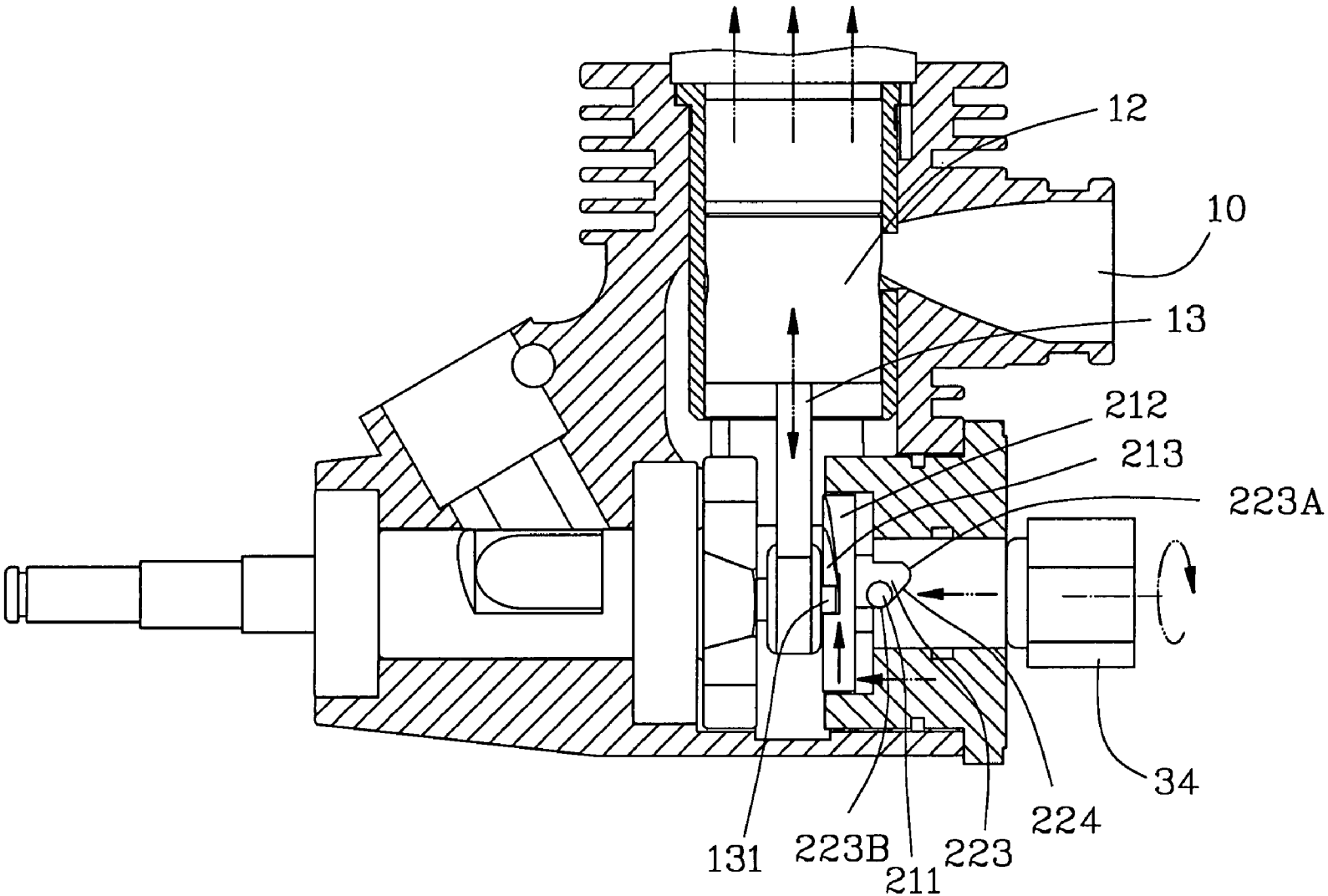
FIG. 5 is a partially side operational view of the manual engine starter in FIG. 2 when starting the engine.

With reference to FIGS. 3–5, the polygonal seat (33) sequentially drives the one-way clutch (34) and the drive shaft (22) when the user rapidly pulls the handle (32). The locking pin (211) on the driven portion (21A) abuts against the guide side (224) and received in the receiving space (223A). The locking pin (211) is moved from the receiving space (223A) to the flat (223B) and the driven shaft (21) is longitudinally moved toward the crank (13) when the driven shaft (21) is driven by the drive shaft (22). Consequently, the protrusion (131) is engaged to the groove (213) and the crank (13) is drive to start engine (10) when the drive shaft (21) is continually rotated to drive the driven shaft (21).

Figure 6:
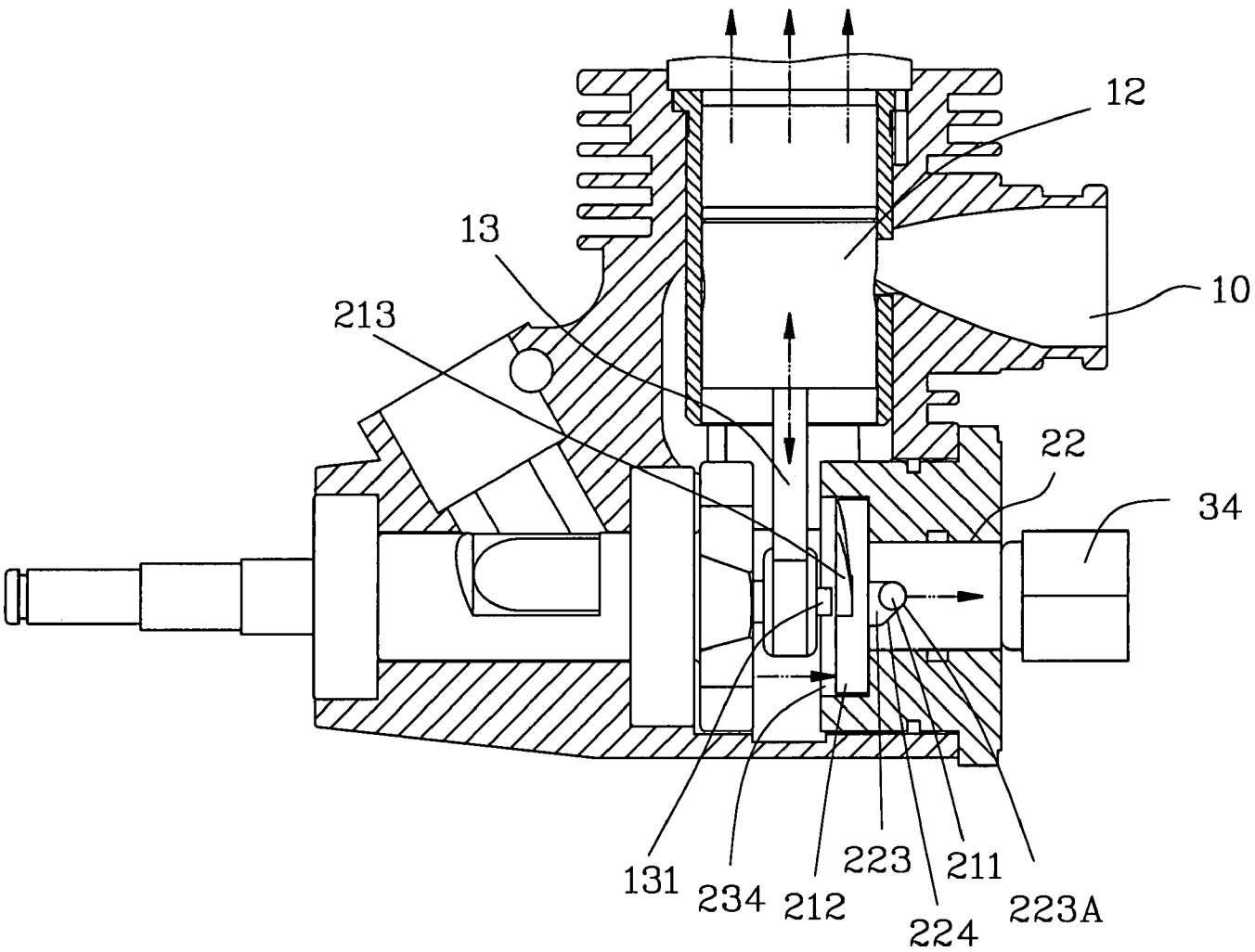
FIG. 6 is a cross-sectional view of the engine after being started.
Figure 7:
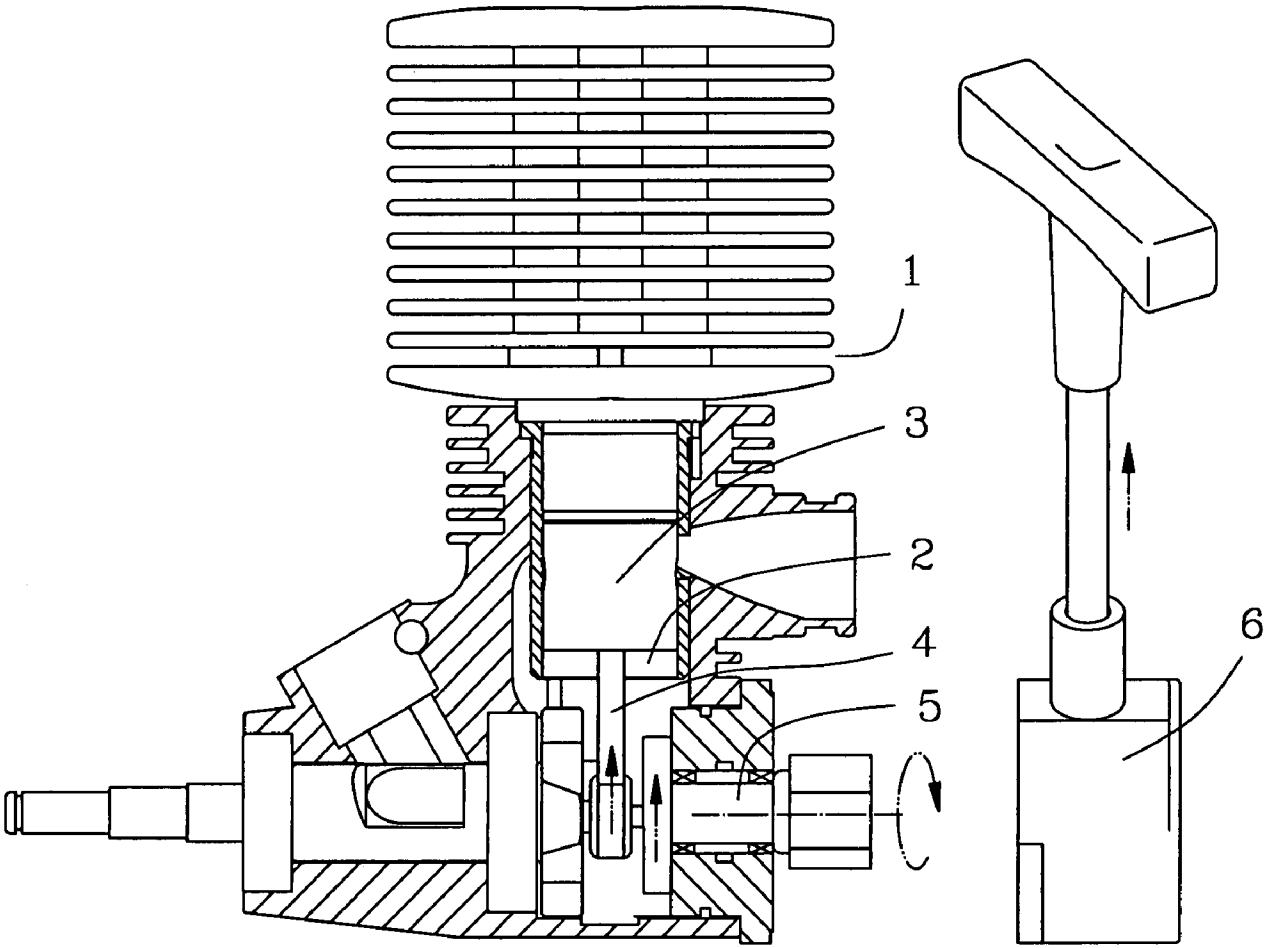
FIG. 7 PRIOR ART
FIG. 7 is a first conventional manual engine starter in accordance with the prior art.
Figure 8:
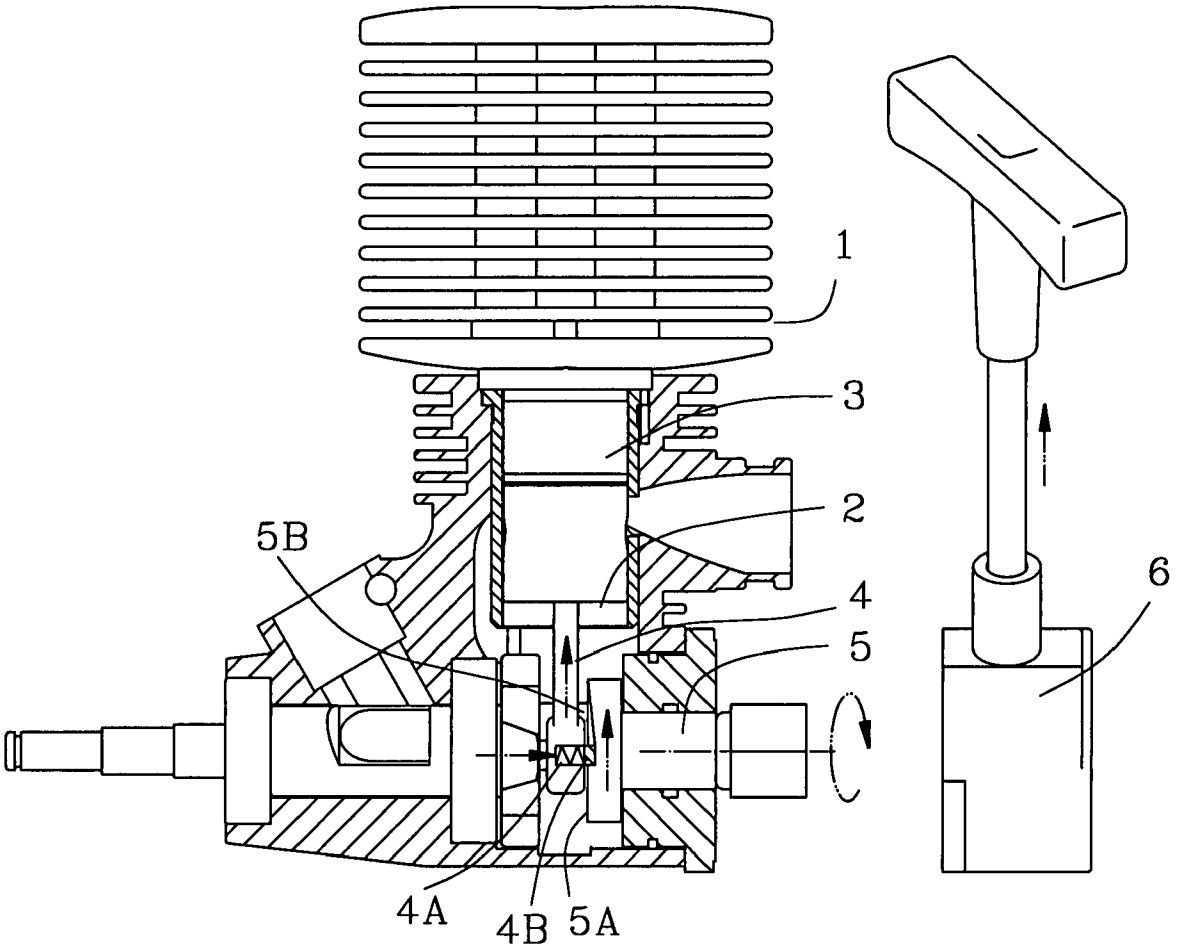
FIG. 8 PRIOR ART
FIG. 8 is a second conventional manual engine starter in accordance with the prior art.

With reference to FIG. 6, the piston (12) is reciprocally moved in the chamber (11) in the engine (10) and continually drives crank (13) when the engine (10) has been started. The operated crank (13) causes a push force that pushes the driven shaft (21) toward the drive shaft (22). Consequently, the two locking pins (211) are respectively moved from the flat (223B) to the receiving space (223A) and the drive dish (212) is deeply received in the cavity (234) in the seat (23). Consequently, the manual engine starter in accordance with the present invention is completely separated from the crank (13). As a result, the manual engine starter never shares the energy from the engine after starting the engine.

Furthermore, the starting device (20) in accordance with the present invention is designed and divided into two sections (driven shaft and drive shaft) longitudinally sleeved on each other. The guide side (224) of the tubular drive portion (22A) leads the driven shaft (21) reciprocally moved along an axis thereof. Consequently, the structures of the tubular drive portion (22A) and the driven portion (21A) can be exchanged relative to each other, and the driven portion (21A) is still moved along the axis thereof due to the guide side (224).

Although the invention has been explained in relation to its preferred embodiment, it is to be understood that many other possible modifications and variations can be made without departing from the spirit and scope of the invention as hereinafter claimed.

What is claimed is:

1. A manual engine starter comprising:

a starting device including a driven shaft adapted to be selectively connected to a crank of the engine and a drive shaft longitudinally connected to the driven shaft for driving the driven shaft and starting the engine, the drive shaft having a tubular drive portion formed with a guide side and the driven shaft having a driven portion that is rotatably received in the tubular drive portion and engaged to the guide side and moved along the guide side so as to make the driven shaft moved along an axis thereof when the drive shaft is rotated to drive the driven shaft, the driven shaft including a drive dish radially extending therefrom opposite to the drive shaft, the drive dish including at least one groove defined along an periphery thereof, the at least one groove adapted to selectively receive a protrusion that laterally extends from a free end of the crank, a seat adapted to be secured on the engine, the seat including a base member and a protrusion extending from the base member, a skirt longitudinally extending from the protrusion of the seat to define a cavity in a free end of the seat for rotatably receiving the drive dish and a through hole defined in the protrusion of the seat, the through hole co-axially communicating with the cavity and rotatable receiving the tubular drive portion of the drive shaft, the cavity having a depth greater than a sum of a thickness of the drive dish and a length of the protrusion of the crank; and a puller laterally mounted on the starting device for drive the drive shaft to drive the driven shaft.

2. The manual engine starter as claimed in claim 1, wherein the tubular drive portion comprises a hole longitudinally centrally defined therein and two indentations defined in an outer periphery of the tubular drive portion, the two indentations diametrically corresponding to each other in the distal end of the tubular drive portion and laterally communicating with the hole in the tubular drive portion, the guide side of the tubular drive portion formed on one side of each of the two indentations, the driven portion including two locking pins laterally secured thereon and diametrically corresponding to each other, each locking pin received in a corresponding one of the two indentations and slidably moved on the guide side to make the driven shaft reciprocally move along the axis thereof.

3. The manual engine starter as claimed in claim 2, wherein each indentation comprises a receiving space formed therein and a flat formed on a distal end of the guide side for driving the locking pin of the driven shaft.

* * * * *